US008584449B2

(12) United States Patent
Willeke et al.

(10) Patent No.: US 8,584,449 B2
(45) Date of Patent: Nov. 19, 2013

(54) MANIFOLD FOR A MULTICYLINDER INTERNAL COMBUSTION ENGINE

(75) Inventors: Winfried Willeke, Attendorf (DE); Christof Henrici, Lennestadt (DE)

(73) Assignee: Faurecia Emissions Control Technologies USA LLC, Columbus, IN (US)

( * ) Notice: Subject to any disclaimer, the term of this patent is extended or adjusted under 35 U.S.C. 154(b) by 1732 days.

(21) Appl. No.: 11/569,405

(22) PCT Filed: May 24, 2005

(86) PCT No.: PCT/EP2005/005593
§ 371 (c)(1),
(2), (4) Date: Aug. 21, 2007

(87) PCT Pub. No.: WO2005/116412
PCT Pub. Date: Dec. 8, 2005

(65) Prior Publication Data

US 2008/0134672 A1 Jun. 12, 2008

(30) Foreign Application Priority Data

May 24, 2004 (DE) ..... 10 2004 025 407

(51) Int. Cl.
*F01N 1/00* (2006.01)

(52) U.S. Cl.
USPC ..... 60/323; 60/322; 60/324

(58) Field of Classification Search
USPC ..... 60/274–324
See application file for complete search history.

(56) References Cited

U.S. PATENT DOCUMENTS

| | | | | |
|---|---|---|---|---|
| 4,850,189 | A * | 7/1989 | Arthur et al. | 60/323 |
| 6,018,946 | A | 2/2000 | Matsumoto et al. | |
| 6,789,386 | B1 | 9/2004 | Haerle | |
| 7,497,079 | B2 * | 3/2009 | Yoshida et al. | 60/323 |

FOREIGN PATENT DOCUMENTS

| | | |
|---|---|---|
| DE | 19957979 | 6/2001 |
| EP | 0765994 | 4/1997 |
| JP | 08109825 | 4/1996 |

OTHER PUBLICATIONS

PCT International Search Report for PCT/EP2005/005593 completed by the European Searching Authority in Aug. 2005.

* cited by examiner

*Primary Examiner* — Thomas Denion
*Assistant Examiner* — Jesse Bogue
(74) *Attorney, Agent, or Firm* — Pamela A. Kachur

(57) ABSTRACT

A manifold for a multicylinder internal combustion engine which includes a plurality of outlets (1) comprises upper, lower and central shells (15, 5, 51) that are connected with one another and define inlet channels and outlet spaces (63, 65). A baffle plate (35) is attached to different shells (5, 15) by means of a fixed/movable bearing and can expand thermally without transferring thermal stresses to the shells (5, 15).

20 Claims, 3 Drawing Sheets

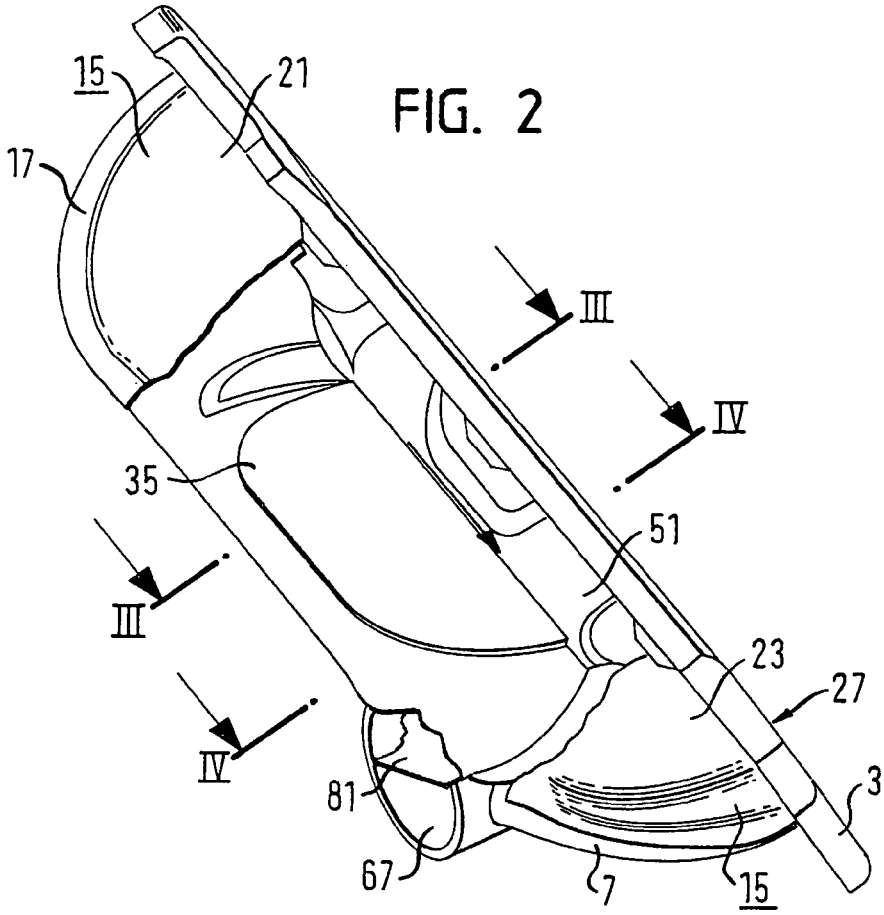
FIG. 2
FIG. 3
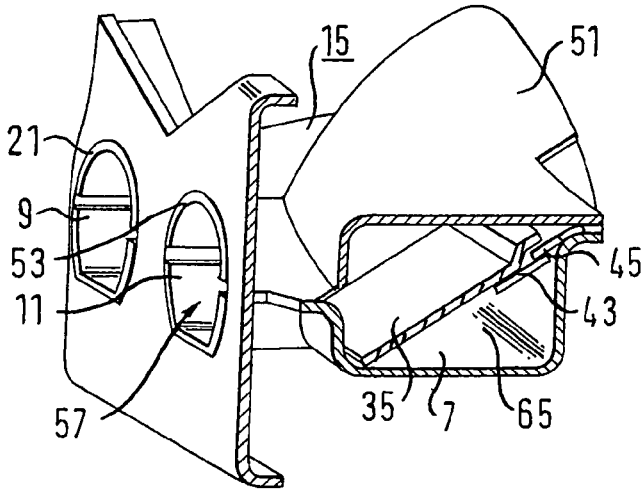

MANIFOLD FOR A MULTICYLINDER INTERNAL COMBUSTION ENGINE

CROSS REFERENCE TO RELATED APPLICATIONS

This application is a U.S. National counterpart application of International Application Serial No. PCT/EP2005/005593 filed May 24, 2005, which claims priority to German Patent Application No. 10 2004 025 407.9 filed May 24, 2004. The entirety of both of these applications is hereby incorporated by reference.

BACKGROUND OF THE INVENTION

The present invention relates to a manifold composed of a plurality of shells, for a multicylinder internal combustion engine.

In particular, the invention relates to a so-called three-shell manifold, in which a lower, an upper and a central shell are connected with one another on the edges, so that a plurality of inlet channels and a plurality of associated outlet spaces are provided. Each outlet on the engine block side opens into a separate, associated inlet channel of the manifold, which in turn continues into an outlet space. Generally, several inlet channels continue into a shared outlet space, in which the hot exhaust gases spread, expand and are cooled to some degree. The manifolds are exposed to extreme thermal stresses. These stresses are extreme in particular in the areas of the connecting weld seams between the shells and the wall sections which are impinged by the exhaust gas stream directly from the engine. Also, especially in a cold start, different sections of the manifold expand with varying degrees of rapidity and intensity, so that high tensions develop here in the areas of the weld seams.

BRIEF SUMMARY OF THE INVENTION

The invention is intended to reduce these stresses on the weld seams and the walls and to largely uncouple the walls of the outlet spaces from one another in terms of forces.

This is achieved by a manifold for a multicylinder internal combustion engine which includes a plurality of outlets, comprising a plurality of shells connected with one another on the edges to provide inlet channels and or at least one outlet space into which the inlet channels or at least some of the inlet channels open, and a baffle plate that is provided for the exhaust gas flowing in via at least one inlet channel and is associated with an outlet space, the baffle plate being firmly connected on the edge at one end with one of the shells and being displaceably connected with another one of the shells at an end remote therefrom.

The exhaust gas from the outlets of the engine which enters the manifold first impinges on the baffle plate which, as a consequence, is subjected to the highest thermal stresses. This baffle plate, however, does not connect shells directly with each other, but is displaceably attached to one shell, so that it can expand thermally without this resulting in tensions between the shells. Furthermore, the baffle plate distributes the flow in the outlet space, forming, as it were, a section of the wall thereof, and in this way provides for a more uniform and faster temperature distribution of the hot exhaust gas in the outlet space, so that the other wall sections of the outlet space are likewise subjected to more uniform and therefore lower stresses as a whole.

According to the preferred embodiment, the manifold according to the invention is provided with lower and upper shells connected with one another on the edges to provide outer inlet channels and an outlet space into which the outer inlet channels open, and a central shell connected on the edge with at least one of the lower and upper shells to provide at least one middle inlet channel located between the outer inlet channels and a second outlet space into which the middle inlet channel opens. The baffle plate is provided for the exhaust gas flowing in via the middle inlet channel and is associated with the second outlet space, and at one end it is firmly connected on the edge with one shell and at an opposite end it is displaceably connected with another shell.

According to the preferred embodiment, one end of the baffle plate is welded to a shell in order to arrange for a secure, rigid connection.

At the displaceable end, the attachment of the baffle plate is constituted e.g. by a U-shaped open end into which an edge projects, so that it is guided between the legs of the U-shaped end.

In this connection it is possible for the edge to be provided on the baffle plate or else, in preference, on a shell, so that in this preferred embodiment the U-shaped end is situated on the baffle plate.

One end of the baffle plate, for example, is attached to the lower shell and prevents the lower shell from being directly impinged by the flow.

The upper shell may have a cut-out in the region of the baffle plate and therefore have the shape of a U, so that the baffle plate is seated inside the "U" and possibly even fills it out completely.

BRIEF DESCRIPTION OF THE SEVERAL VIEWS OF THE DRAWINGS

Further features and advantages of the invention will be apparent from the description below and from the accompanying drawings, to which reference is made and in which:

FIG. 2 shows a perspective top view onto the manifold according to the invention, with the central shell being illustrated partly cut open in the middle in order to expose a view onto the baffle plate; and FIGS. 3 and 4 show perspective sectional views in the regions of the planes and IV-IV, but slightly turned in order to expose the view onto the cut-open manifold in the area of the second outlet space.

DETAILED DESCRIPTION OF THE INVENTION

Figure 1:
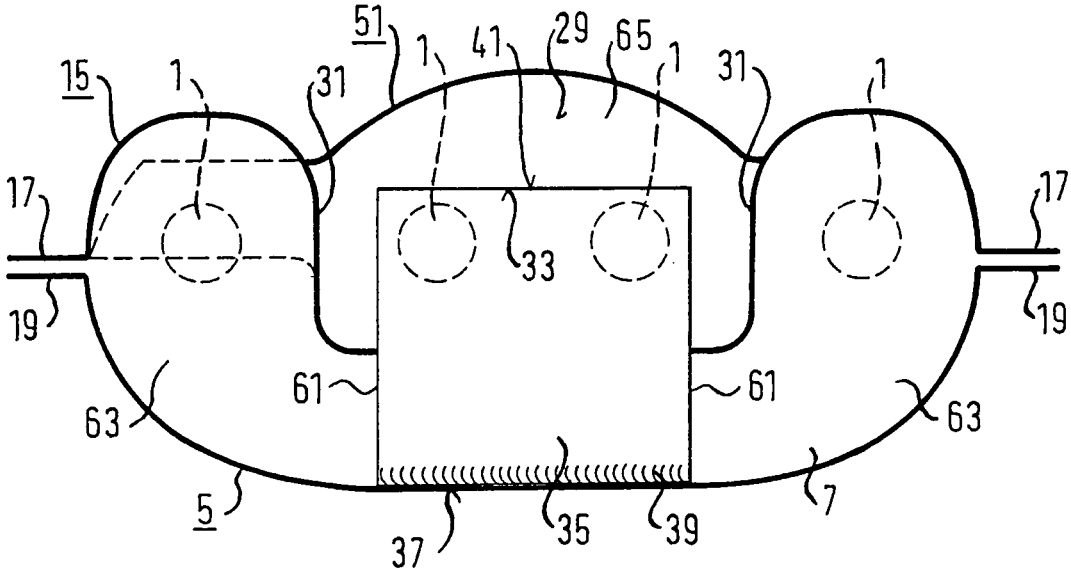
FIG. 1 shows a diagrammatic sectional view of the manifold according to the invention in a plane parallel to the engine flange.

FIG. 1 illustrates a manifold for a four-cylinder internal combustion engine, the internal combustion engine having four outlets 1 which, in relation to the cutting plane of FIG. 1, would be located above the plane of projection and are indicated by broken lines only for the purpose of an enhanced understanding.

The manifold, which is bolted to the engine block, has a flat, plate-like flange 3 (see FIG. 2) and three shells made of sheet metal and connected with each other, which define inlet channels for each outlet 1 and outlet spaces that combine a plurality of inlet channels.

A lower shell 5 made of sheet metal has a trough-shaped section 7 and four extensions which protrude to the flange 3 and have been reshaped to form a lower tube part 9, 11 and 13. Because of the sections performed, the fourth lower tube part is not shown in the figures. Each lower tube part 9 through 13 has the shape of a half-shell. The lower tube parts 9 through 13 project through corresponding openings in the flange 3 and are attached thereto.

Placed on the lower shell 5 is an upper shell 15 having an outer edge 17 which is welded and/or crimped to the outer edge 19 of the lower shell 5. The upper shell 15 has only two extensions pointing towards the flange 3, which have been reshaped into upper tube parts 21, 23 in the shape of half-shells (see FIG. 2). The upper tube parts 21, 23 are in contact with the two outer lower tube parts (lower tube part 9 and the lower tube part that is not shown) and are connected with the latter on the edges, so that two outer inlet channels 25, 27 are formed, which are associated with the outer outlets 1.

In the region of the middle outlets 1, the upper shell 15 has a depression (see FIG. 1) which extends remote from the flange 3 to closer to the flange 3 increasingly downward towards the lower shell 5. This depression is defined by a wall 29 facing the rear side of the flange and by side walls 31 which continue into the wall 29. The wall 29 has a cut-out 33, so that the upper shell 15, as viewed from the top, is formed in the shape of a U.

Figure 4:
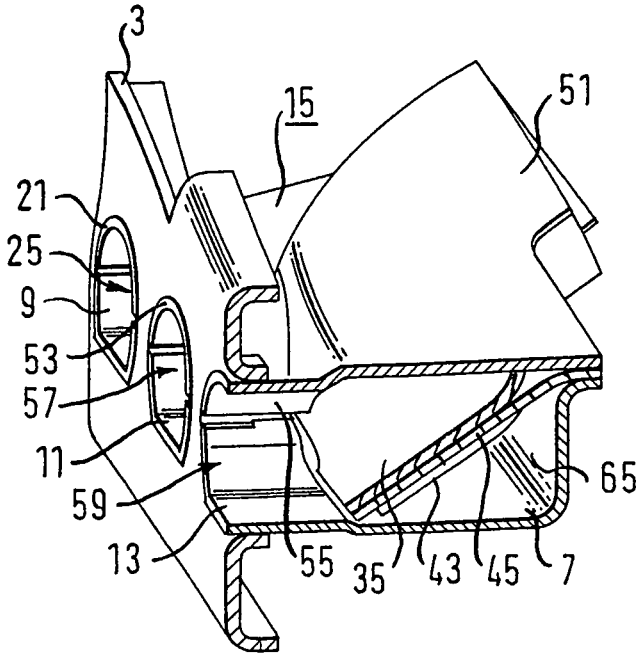

The width of the cut-out 33, as related to FIG. 1, is adapted to the width of the baffle plate 35, which has a lower end 37 welded to the lower shell 5, the weld seam being denoted by 39. The width of the baffle plate 35 is selected such that in the view according to FIG. 1, it covers both projections of the middle outlets 1. As shown in FIGS. 3 and 4, the baffle plate 35 extends from the lower shell 5 obliquely upward and away from the flange 3 towards the wall 29, which likewise extends obliquely upward and away from the flange 3.

The wall 29 and the baffle plate 35 partly run parallel to each other in the vicinity of the lateral edges of the baffle plate 35.

A U-shaped metal plate 43 which extends across the entire width of the baffle plate 35 is welded onto the rear side of the baffle plate 35, in the area of the upper end 41 thereof (see FIGS. 3 and 4). The metal plate 43 also extends downward along the lateral edges of the baffle plate 35. The baffle plate 35 and the metal plate 43 are somewhat bent away from each other behind the welding point, so that they constitute a receiving groove which is U-shaped in cross-section and open to the outside and which extends along the lateral edges and the upper end 41. The edge 45 of the cut-out 33 is inserted so as to be displaced within this receiving groove, so that a displaceable bearing is produced between the baffle plate 35 and the upper shell 15.

A central shell 51 is located above the area of the indentation of the upper shell 15 and the baffle plate 35. The central shell 51 has two extensions pointing towards the flange 3, which form upper tube parts 53, 55 and are connected with the middle lower tube parts 11, 13 of the lower shell 5 to define two middle inlet channels 57, 59.

The displaceable connection between the upper shell 15 and the baffle plate 35 may be, but need not be, limited to the upper edge 41. Rather, as described above, additionally or alternatively the lateral edges of the baffle plate 35 may also be correspondingly connected for displacement with the upper shell 15.

The lower and upper shells 5, 15 constitute a common outlet space 63 which extends beneath the baffle plate 35 and into which the two outer inlet channels 25,27 open.

The two middle inlet channels 57, 59 open into a common, second outlet space 65 which is defined by the baffle plate 35, the middle portion of the upper shell 15, and the central shell 51.

Both outlet spaces 63, 65 lead to a single exhaust pipe 67 (FIG. 2), which is defined by the lower and central shells 5, 51.

The exhaust pipe 67 is divided in two by a tongue 81 of the upper shell 15 running transversely through the exhaust pipe 67, dividing it into an upper section for the middle inlet channels 57, 59 and a lower section for the outer inlet channels 25, 27.

This division of the flow is advantageous if a turbocharger operating according to the twin scroll concept is connected to the manifold.

As an alternative, the outlet spaces 63, 65 could also be united within the manifold, or else a shared outlet space could be provided.

The exhaust gas flowing into the middle inlet channels 57, 59 strikes directly onto the baffle plate 35 and is distributed by the latter in the second outlet space 65 to finally reach the exhaust pipe 67, from where it flows to the turbocharger and to exhaust gas purification systems.

The invention claimed is:

1. A manifold for a multi cylinder internal combustion engine which includes a plurality of outlets, comprising:

a plurality of shells connected with one another on corresponding edges to provide inlet channels and at least one outlet space into which the inlet channels open, and a baffle plate that is provided for the exhaust gas flowing in via at least one inlet channel and is associated with an outlet space, the baffle plate being firmly connected on the edge at one end with one of the shells and being displaceably connected with another one of the shells at an end remote therefrom.

2. The manifold according to claim 1, wherein:

the plurality of shells includes lower and upper shells connected with one another on the edges to provide outer inlet channels and a first outlet space into which the outer inlet channels open, the plurality of shells further includes a central shell connected on the edge with at least one of the lower and upper shells to provide at least one middle inlet channel located between the outer inlet channels and a second outlet space into which the middle inlet channel opens, and the baffle plate being provided for the exhaust gas flowing in via the middle inlet channel and being associated with the second outlet space.

3. The manifold according to claim 2, wherein the baffle plate is attached to the lower shell.

4. The manifold according to claim 2, wherein the upper shell has a cut-out in the region of the baffle plate and is V-shaped.

5. The manifold according to claim 1, wherein the displaceably connected end of the baffle plate is located opposite to the firmly connected end.

6. The manifold according to claim 1, wherein one end of the baffle plate is welded to a shell.

7. The manifold according to claim 1, wherein the displaceable end is a U-shaped open end into which an edge projects and is guided therein.

8. The manifold according to claim 7, wherein the baffle plate has the U-shaped open end.

9. A manifold for a multi cylinder internal combustion engine which includes a plurality of outlets, comprising:

a plurality of shells welded with one another on corresponding edges to provide inlet channels and at least one outlet space into which the inlet channels open, and a separate baffle plate that is provided for the exhaust gas flowing in via at least one inlet channel and is associated with an outlet space, the baffle plate being welded on the edge at one end with only one of the shells and being displaceably connected with another one of the shells at an end remote therefrom.

10. The manifold according to claim 1, wherein the plurality of shells includes at least an upper shell and a lower shell that are directly connected to each other at the corresponding edges, and wherein the baffle plate has a lower end fixed to the lower shell and an upper end comprising a guide that displaceably receives a portion of the upper shell.

11. The manifold according to claim 10, wherein including a metal plate fixed to the baffle plate at an area of the upper end to form a U-shaped groove, and wherein the upper shell includes a cut-out that is adapted to a width of the baffle plate, and wherein an edge of the cut-out is received within the U-shaped groove.

12. The manifold according to claim 11, wherein the plurality of shells includes a central shell positioned above the baffle plate, the central shell connected along an edge to at least one of the upper and lower shells.

13. The manifold according to claim 9, wherein the plurality of shells includes at least an upper shell and a lower shell that are directly connected to each other at the corresponding edges, and wherein the upper shell includes a cut-out portion that corresponds generally to a width of the baffle plate, and wherein the baffle plate has a lower end fixed to the lower shell and an upper end having a groove that displaceably receives an upper edge of the cut-out portion of the upper shell.

14. A manifold for a multi cylinder internal combustion engine which includes a plurality of outlets, comprising:

an upper shell having an outer peripheral edge;

a lower shell having an outer peripheral edge directly connected to the outer peripheral edge of the upper shell;

a central shell having an outer peripheral edge that is connected to at least one of the upper and lower shells, wherein the upper, lower, and central shells cooperate to provide a plurality of inlet channels and at least one outlet space into which the inlet channels open; and a baffle plate provided for exhaust gas flowing in via at least one of the plurality of inlet channels, wherein the baffle plate extends obliquely relative to a direction of exhaust gas flow and includes a lower end that is fixed to the lower shell and an upper end that is displaceably connected to the upper shell.

15. The manifold according to claim 14, including a metal plate fixed to the baffle plate at an area of the upper end to form a U-shaped groove, and wherein the upper shell includes a cut-out that is adapted to a width of the baffle plate, and wherein an edge of the cut-out is received within the U-shaped groove.

16. The manifold according to claim 14, wherein the baffle plate has a groove at an upper end and wherein a portion of the upper shell is displaceably connected to the baffle plate within the groove.

17. The manifold according to claim 14, wherein the plurality of inlets comprises at least a first set of inlets and a second set of inlets, and wherein the upper and lower shells cooperate to provide a first common outlet space into which the first set of inlets open, and wherein the baffle plate, middle shell, and upper shell cooperate to provide a second common outlet space, independent of the first common outlet space, into which the second set of inlets open.

18. The manifold according to claim 17, including a single exhaust pipe defined by the lower and central shells, and wherein both the first and second common outlet spaces lead to the single exhaust pipe.

19. The manifold according to claim 18, wherein the single exhaust pipe is divided into two portions by a tongue running transversely through the exhaust pipe with one portion leading to the first common outlet space and the other portion leading to the second common outlet space.

20. The manifold according to claim 14, wherein the upper end of the baffle plate comprises a guide for a portion of the upper shell.

* * * * *